US010027053B2

(12) United States Patent
Antonini et al.

(10) Patent No.: US 10,027,053 B2
(45) Date of Patent: Jul. 17, 2018

(54) ELECTRICAL CONNECTOR WITH SEALING BOOT

(71) Applicant: Molex, LLC, Lisle, IL (US)

(72) Inventors: Gino Antonini, New Fairfield, CT (US); John Connolly, Goshen, CT (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/513,474

(22) PCT Filed: Sep. 25, 2015

(86) PCT No.: PCT/US2015/052316
§ 371 (c)(1),
(2) Date: Mar. 22, 2017

(87) PCT Pub. No.: WO2016/049505
PCT Pub. Date: Mar. 31, 2016

(65) Prior Publication Data

US 2017/0250497 A1 Aug. 31, 2017

Related U.S. Application Data

(60) Provisional application No. 62/055,970, filed on Sep. 26, 2014.

(51) Int. Cl.
*H01R 13/52* (2006.01)
*H01R 9/05* (2006.01)
(Continued)

(52) U.S. Cl.
CPC ..... *H01R 13/5205* (2013.01); *H01R 9/0521* (2013.01); *H01R 13/5213* (2013.01);
(Continued)

(58) Field of Classification Search
CPC ..... H01R 13/5205
See application file for complete search history.

(56) References Cited

U.S. PATENT DOCUMENTS 4,795,370 A * 1/1989 Freitag ..... H01R 24/40 439/584
5,886,294 A * 3/1999 Scrimpshire ..... G02B 6/3887 174/359

(Continued)

FOREIGN PATENT DOCUMENTS

CN 102447172 A 9/2012

OTHER PUBLICATIONS

File: SureFlex_BR-104351.pdf, "HELIAX SureFlex premium cable assemblies," retrieved from internet: www.commscope.com/SiteSearch/?q=sureflex+br-104351 [retrieved on Mar. 16, 2017].

*Primary Examiner* — James Harvey
(74) *Attorney, Agent, or Firm* — Jeffrey K. Jacobs

(57) ABSTRACT

An electrical coaxial connector system includes a plug connector and a receptacle connector. The plug connector has an elastomeric boot disposed on the plug connector having a peripheral sealing lip formed on the peripheral opening of the boot. Upon mating of the plug and receptacle connectors the boot is advanced along a mating direction and installed to a sealing position with a one handed operation and further having additional tactile feedback to indicate complete installation of the sealing boot.

18 Claims, 11 Drawing Sheets

(51) Int. Cl.

| | |
|---|---|
| ***H01R 24/38*** | (2011.01) |
| ***H01R 43/00*** | (2006.01) |
| *H01R 103/00* | (2006.01) |

(52) U.S. Cl.
CPC ..... *H01R 24/38* (2013.01); *H01R 43/005* (2013.01); *H01R 2103/00* (2013.01)

(56) References Cited

U.S. PATENT DOCUMENTS

| | | | | |
|---|---|---|---|---|
| 6,429,373 | B1 | 8/2002 | Scrimpshire et al. | |
| 8,303,339 | B2 | 11/2012 | Montena | |
| 8,454,385 | B2 | 6/2013 | Chawgo et al. | |
| 8,529,288 | B2 | 9/2013 | Montena et al. | |
| 9,616,602 | B2 * | 4/2017 | Vaccaro | H02G 1/14 |
| 2005/0164553 | A1 * | 7/2005 | Montena | H01R 9/0518 439/578 |
| 2008/0085631 | A1 | 4/2008 | Holland | |
| 2009/0114424 | A1 | 5/2009 | Holland | |
| 2010/0255721 | A1 | 10/2010 | Purdy et al. | |
| 2012/0196464 | A1 | 8/2012 | Lu | |
| 2014/0045357 | A1 | 2/2014 | Nugent | |
| 2017/0250497 | A1 * | 8/2017 | Antonini | H01R 13/5213 |

* cited by examiner

ELECTRICAL CONNECTOR WITH SEALING BOOT

RELATED APPLICATIONS

This application claims priority to U.S. Provisional Application No. 62/055,970, filed Sep. 26, 2014 which is incorporated herein by reference in its entirety.

FIELD OF THE INVENTION

The present disclosure relates to field of Coaxial Electrical Connectors.

DESCRIPTION OF RELATED ART

The present disclosure generally relates connectors for use in coupling coaxial cables that comprise an inner conductor, an outer conductor concentrically disposed around the inner conductor and a non-conducting insulation uniformly disposed therebetween. Coaxial cables are used in many applications where it is necessary to carry radio frequency or microwave frequency electrical signals. Coaxial cables often are employed in high vibration and harsh environments such as in ground, air or marine vehicles, weapons systems and many machines.

BRIEF SUMMARY

A coaxial connector system is provided that includes a plug connector and a receptacle connector. The connector system typically includes a plug connector assembly configured to be attached to the end of a cable and a receptacle connector that can be configured to be mounted on a cable or mounted to a circuit board.

The plug connector is mounted on a coaxial cable and includes a generally cylindrical body portion, a coupling nut, an insulator and a conductive terminal contact. The plug connector can include a water resistant elastomeric seal or boot. One can appreciate an easily attachable sealing boot that can be assembled in the field.

BRIEF DESCRIPTION OF THE DRAWINGS

The present disclosure is illustrated by way of example and not limited in the accompanying figures in which like reference numerals indicate similar elements and in which.

DETAILED DESCRIPTION

FIGS. 1-12 illustrate an embodiment of the coaxial connector system and it is to be understood that the disclosed embodiments are merely exemplary. Therefore, specific details disclosed herein are not to be interpreted as limiting, but merely as a basis fir the claims and as a representative basis for teaching one skilled in the art.

Figure 1:
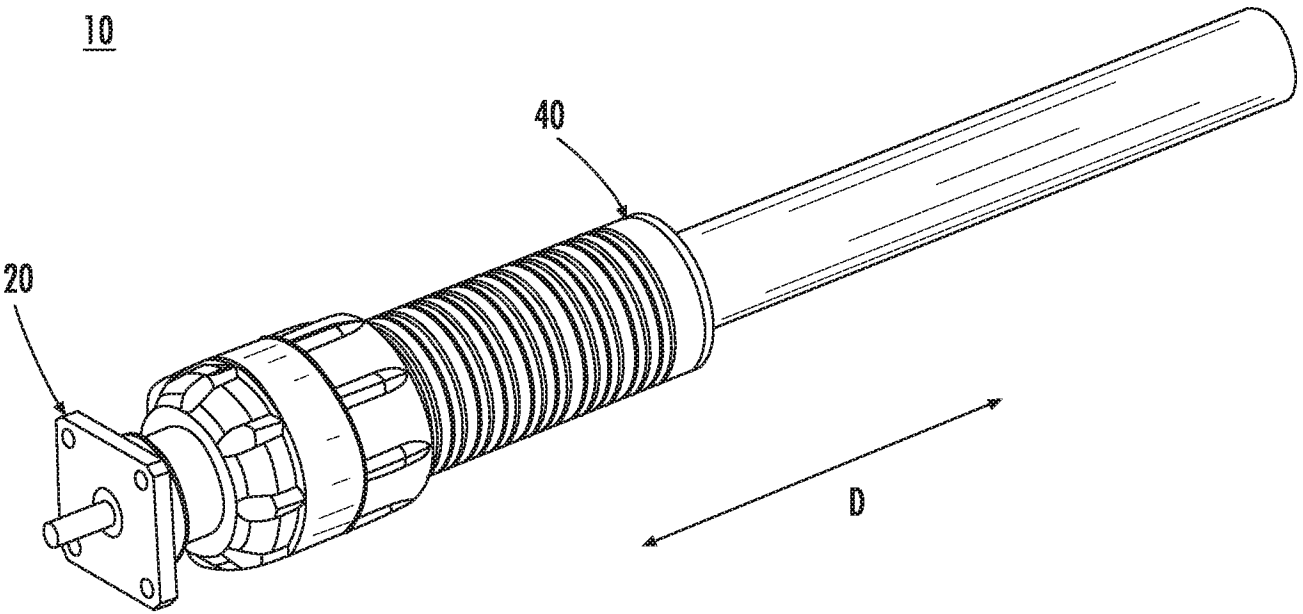
FIG. 1 is a perspective view of the coaxial connector system.
Figure 2:
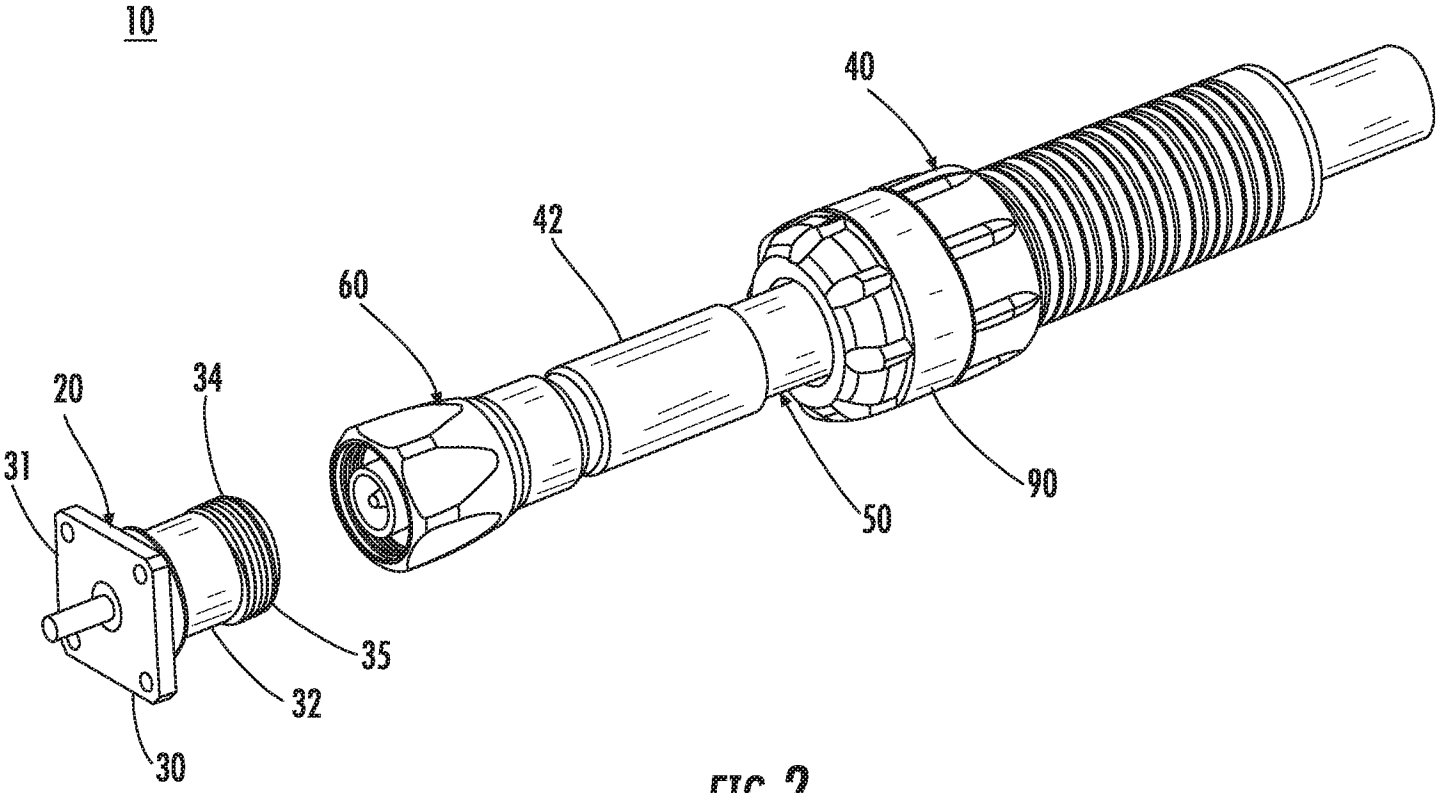
FIG. 2 is a perspective view of the coaxial connector system of FIG. 1 in an unmated condition.
Figure 4:
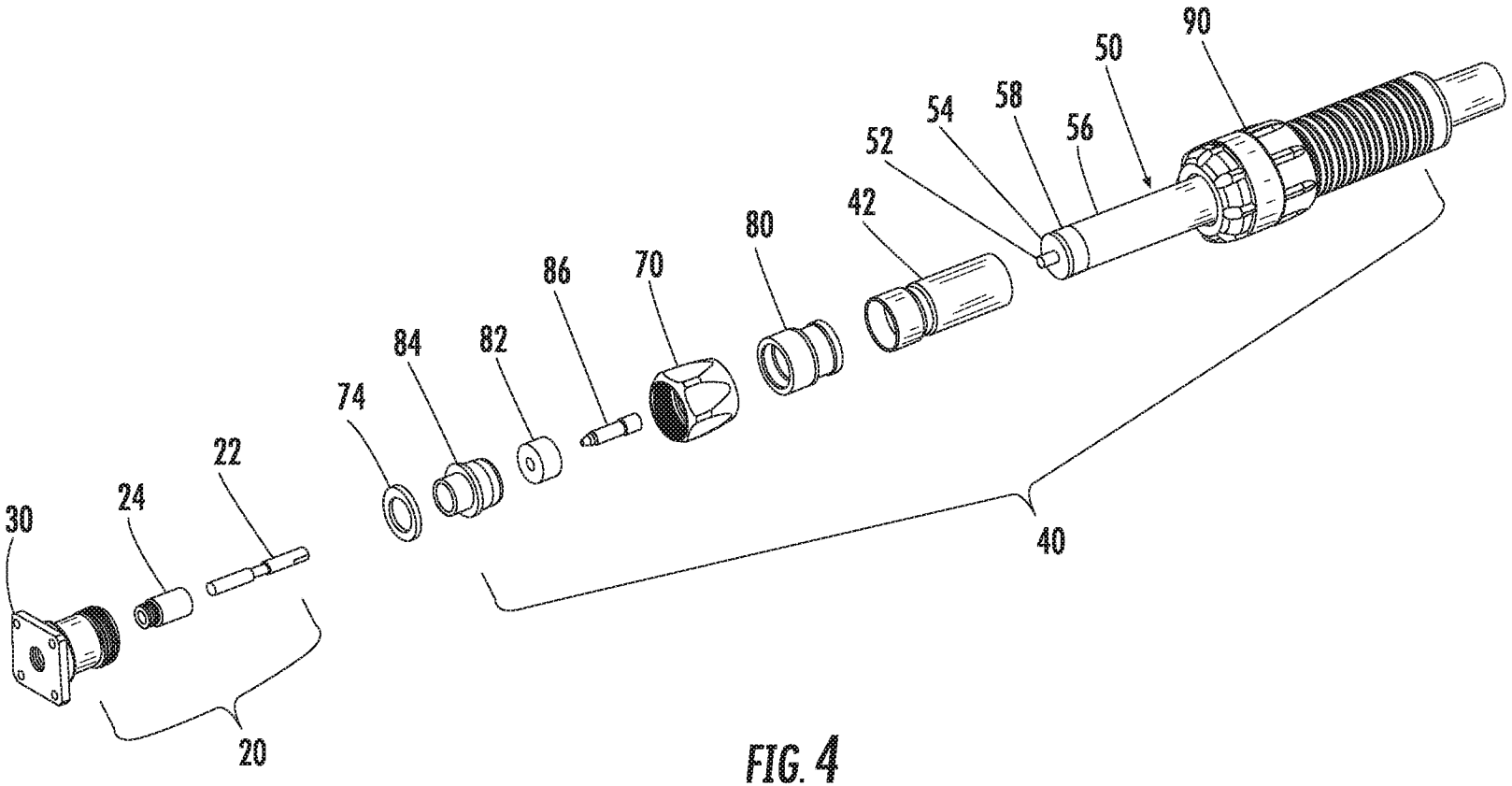
FIG. 4 is an exploded view of the coaxial connector system of FIG. 1.

As depicted in FIGS. 1 and 2, the connector system 10 includes a receptacle connector 20, which can be mounted to a printed circuit board (not shown) and a plug connector 60 for mating with the receptacle connector 20 along a mating direction D, the plug connector 60 is disposed on an end of a cable 50 so as to form a cable assembly 40. As best shown in FIG. 4 the receptacle connector 20 includes a housing 30 having an exterior conductive shell and a center conductor 22 generally surrounded by an insulating material 24. The receptacle connector 20, as is known, can be configured with a vertical orientation or a right angle orientation.

As illustrated in FIGS. 2 and 4, the connector system includes a cable assembly 40 configured for connection to a receptacle 20 along the mating direction D. The receptacle connector 20 includes a housing 30 having a circular mating end 34 adjacent a body 32 with the body 32 extending from a base 31. As further illustrated in FIG. 6, the housing 30 includes a passage extending through the housing 30 from the base 31 to the mating end 34. The center conductor 22 is disposed in the passage and secured in place by insulative material 24. External threads 35 are formed on the exterior of the circular mating end 34 configured to engage corresponding threaded portions 77 in an opening 76 of the plug connector 60. The center conductor 22 includes a mating end 23 for connection to a corresponding center contact 86 of the plug connector 60 and a mounting end 21 for electrical connection to a circuit board (not shown). In operation the center conductor 22 is electrically coupled to a signal trace formed on the circuit board and the conductive housing is coupled to a ground trace also formed on the circuit board.

Figure 3:
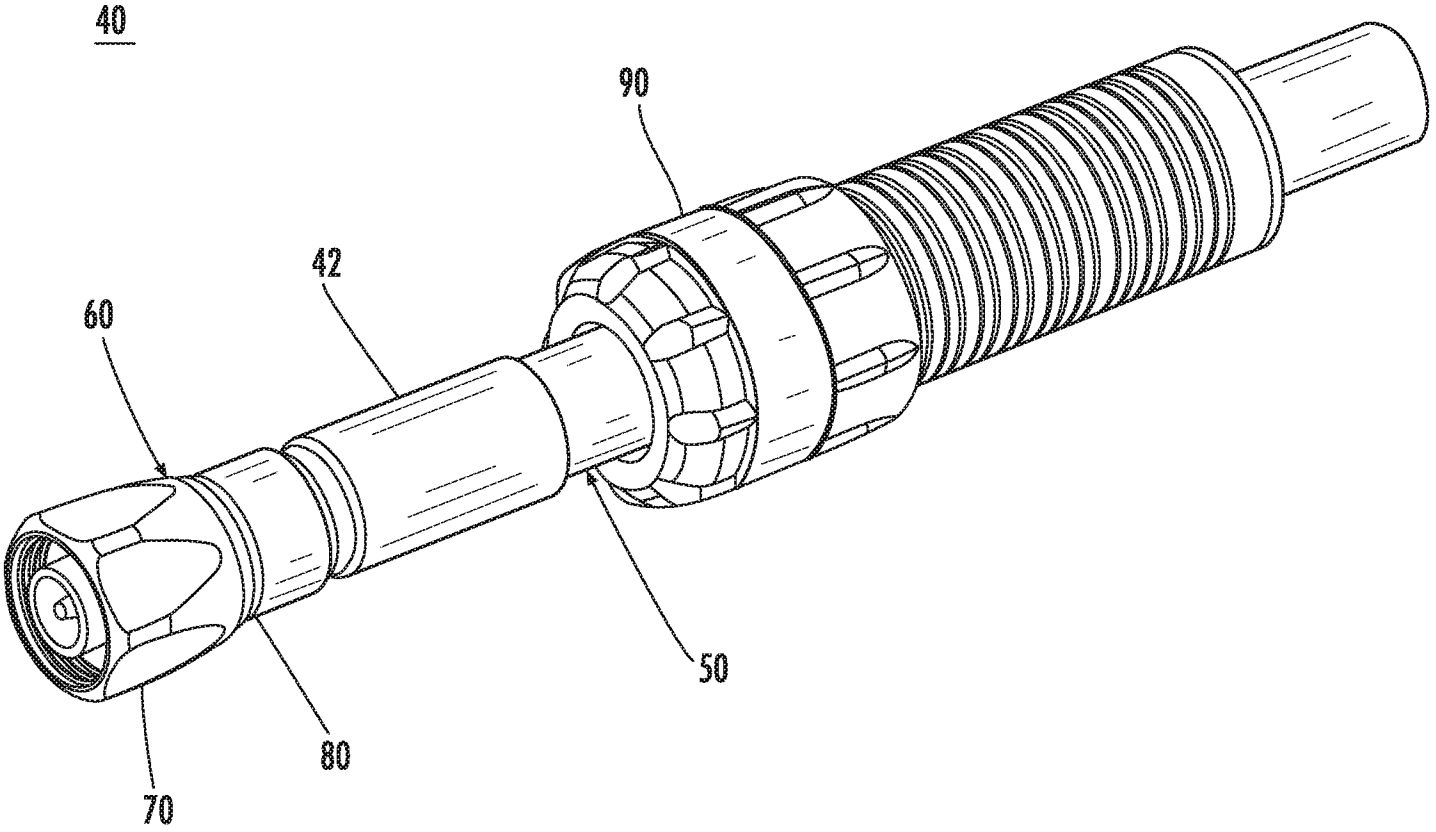
FIG. 3 is a perspective view of the plug connector of the coaxial connector system of FIG. 1.
Figure 5:
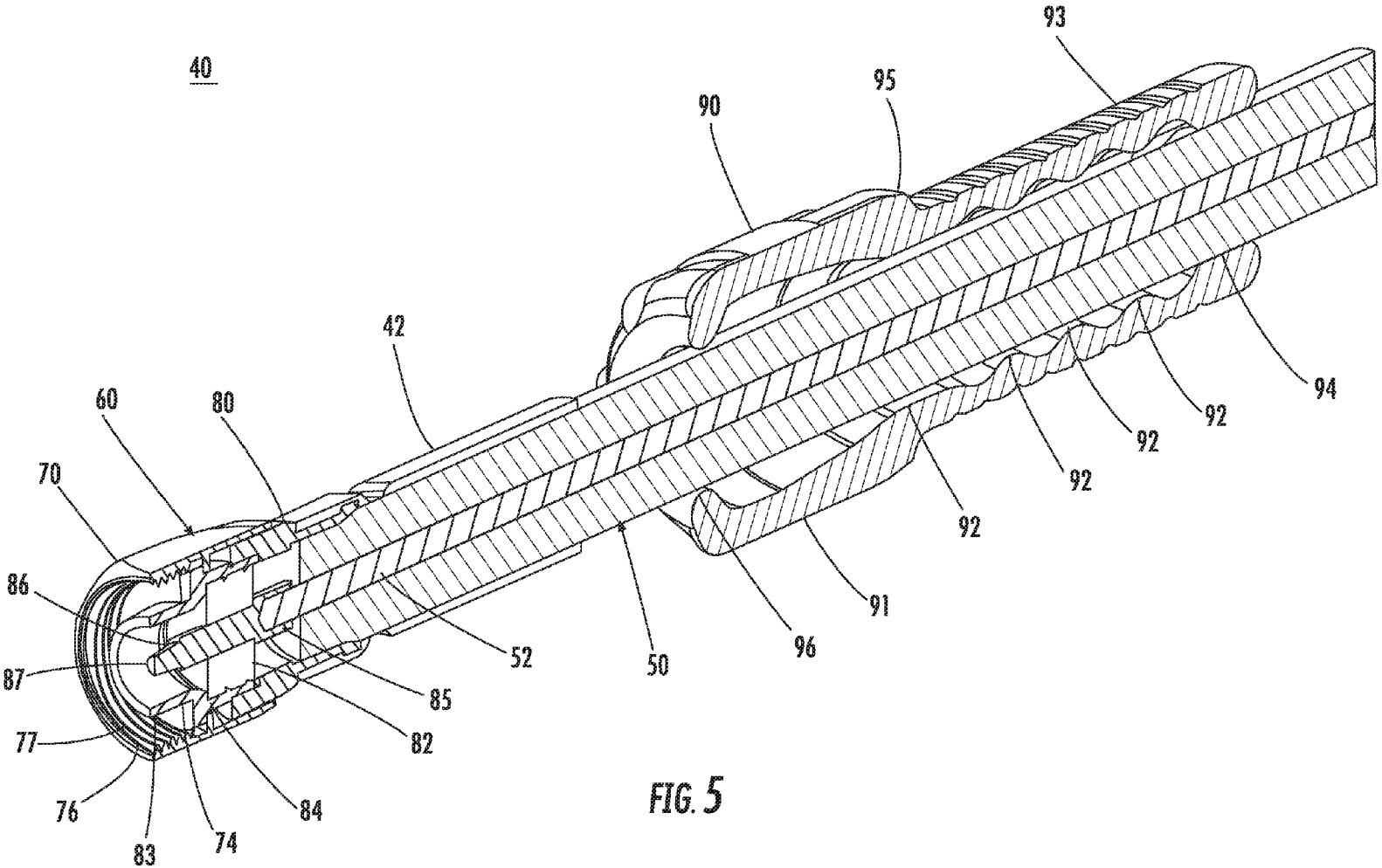
FIG. 5 is a section view of the plug connector of FIG. 3.

As depicted in FIGS. 3-5 the cable assembly 40 includes a receptacle connector 60 that is adapted to be mechanically and electrically connected to a cable 50. In the embodiment shown, the cable assembly is a coaxial type used in RF applications. As best illustrated in FIG. 4, the cable 50 includes a center conductor 52, an insulator 54 surrounding the center conductor 52. An outer conductor 58 is disposed around the insulator 54, in this embodiment the outer conductor is constructed from a conductive mesh or braid providing an electromagnetic shielding layer with an insulative jacket surrounding the cable.

Figure 7:
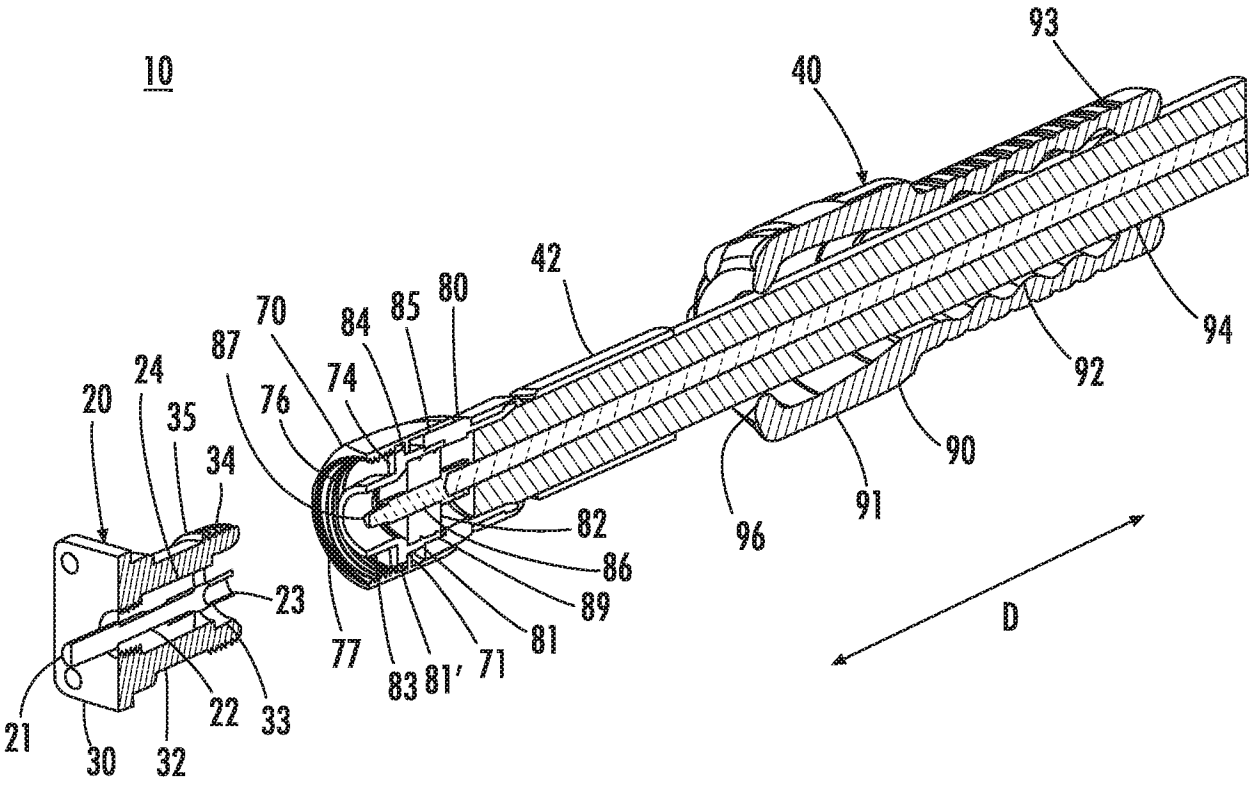
FIG. 7 is a section view of the coaxial connector system prior to mating.
Figure 8:
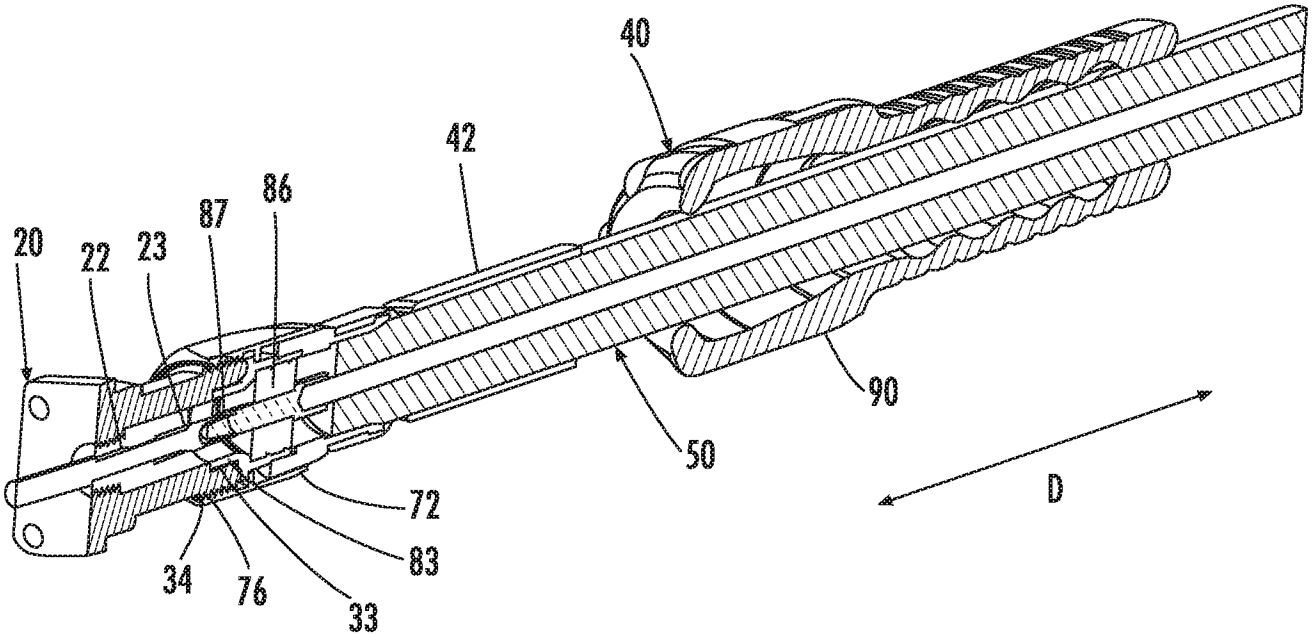
FIG. 8 is a section view of the coaxial connector system with the plug connector and the receptacle connector just after mating.
Figure 9:
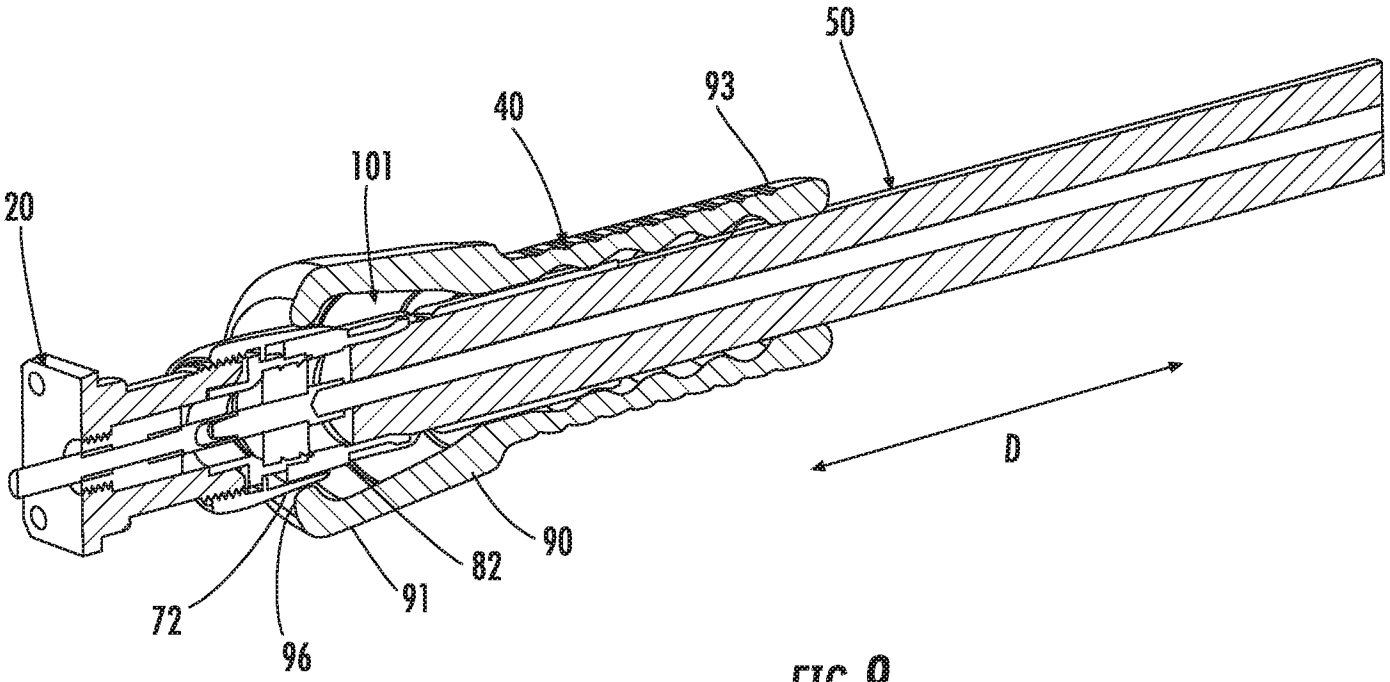
FIG. 9 is a section view of the coaxial connector system after mating and during sealing boot installation.
Figure 10:
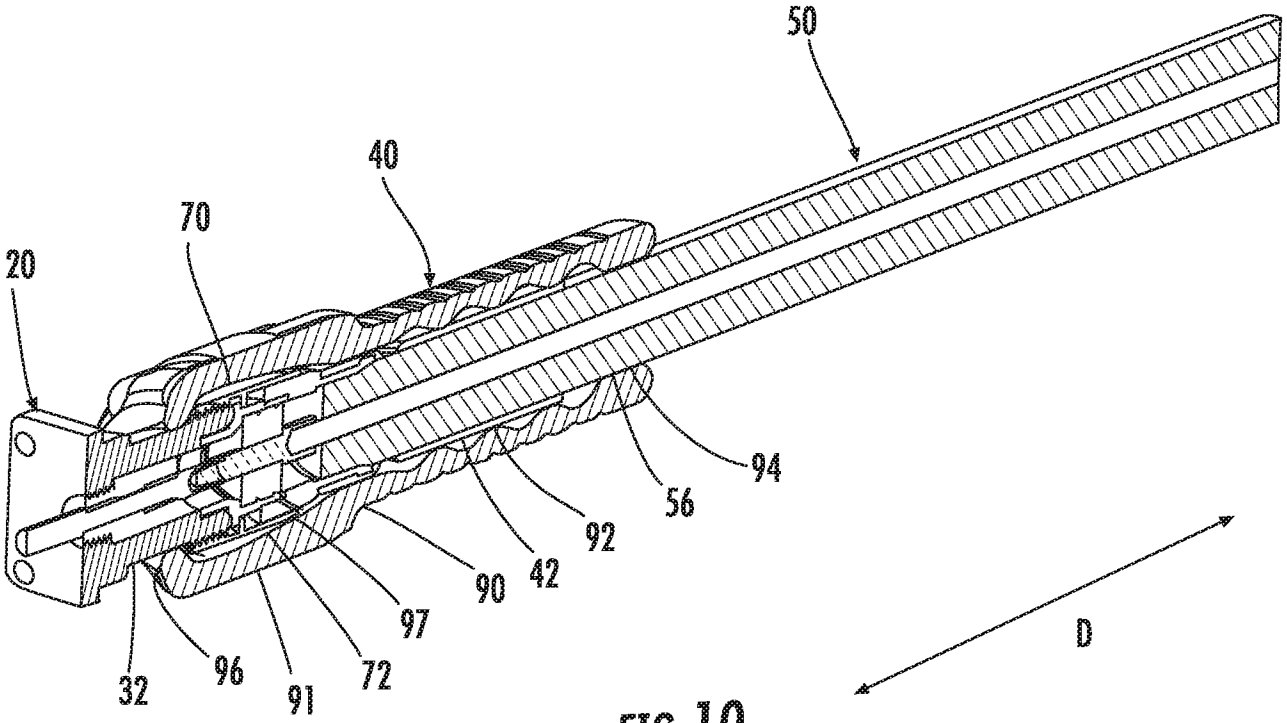
FIG. 10 is a section view of the coaxial connector system after mating and sealing boot installation.

The plug connector 60 is constructed of a first body 80 formed from a conductive material, a second body 84 similarly formed from a conductive material with a coupling nut 70 captivated between the first body 80 and the second body 84. As best illustrated in FIG. 7 the first body 80 is formed in a generally cylindrical shape with a circular extension 85 having a shoulder 81 formed on the extension 85. The second body 84 is formed in a generally cylindrical shape, with an inner mating cylindrical portion 83 extending from a shoulder 81 and a mounting section 89 is formed on the opposing end of the inner mating cylindrical portion 83. The coupling nut 70 is also formed from a conductive material. The plug connector 60 includes an opening 76 formed in the coupling nut 70 configured to engage the mating end 34 of housing 30 of the receptacle connector 20.

A center contact is positioned within the first body 80 and the second body 84 and secured in place by an insulator 82. A boot 90 is disposed on the cable 50 in an initial position and slid over the connection between the plug 40 and receptacle 20 after mating to an installed position. The boot 90 is formed from an elastomeric material such as silicone but similar materials can be appreciated and includes a first enlarged end 91 and a second gripping end 93 and is configured to be slidably mounted on the cable 50. An elastomeric gasket 74 is disposed in the opening 76 of the coupling nut 70 and is positioned adjacent the second body 84 and encircles the center contact 86.

As shown in FIGS. 4 and 5, attachment of the plug connector 60 to the coaxial cable 50 the end of the coaxial cable 50 is accomplished by preparing the attachment end of the cable 50 by first removing a portion of the exterior jacket 56 exposing a portion of the outer conductor 58. Subsequently a portion of the outer conductor 58 and the dielectric 54 is removed exposing the center conductor 52. Essentially, the stripped end of the cable 50 is stepped, that is, a series of stepped portions are exposed. Starting at the stripped end of the cable, the first step is the center conductor 52, the second step is the exposed dielectric 54, the third step is the exposed outer conductor 58 and the last step is the exterior jacket 56.

As best illustrated in the FIG. 5, the plug connector 60 is attached to the stripped end of the cable 50. During this step, the boot 90 is first slipped unto the cable 50 and slid rearward in the opposing direction of D to an initial position, after which, the heat shrinkable tube 42 is similarly placed on the cable 50. Once the boot 90 and heat shrinkable tube 42 are in place on the cable 50, the first body 80 is also then slid unto the cable 50, essentially these components are staged on the cable 50 with the stripped end of the cable 50 exposed beyond the components. At this time the insulator 82 which includes an opening is inserted into a pocket formed in the second body 84 and secured in place by a press fit and retention barbs. The center contact 86 is inserted into the opening formed in the insulator 82 and secured in place by a similar press fit construction and subsequently, the coupling nut 70 is placed or staged on the second body.

At this time the center conductor 52 of the cable 50 is electrically coupled to the center contact 86 usually by soldering or welding. Once the center conductor 52 and the center contact 86 are soldered together, the rear body 80 and the front body 84 are pressed together. During this operation the extension 85 formed in the first body is forced over the mounting section 89 securely holding the first body 80 and the second body 84 together. The coupling nut 70 is secured and captivated between the first body 80 and the second body 84 with a sliding fit allowing the coupling nut 70 to freely rotate around the first and second bodies 80, 84 as best illustrated in FIG. 5. The coupling nut 70 includes a flange 71 that extends radially inward and is disposed between a shoulder 81 formed on the first body 80 and a second shoulder 81' formed on the second body 84 therefore captivating in place. In operation, as the flange 71 abuts either shoulder 81, 81', an axial force along mating direction D can be imparted to the cable 50 for mating and un-mating the connector system 10. In alternate embodiments the shoulder 81 on the first body 80 is optional, only the shoulder 81' on the second body 84 is needed to draw the cable together with the receptacle 20 upon mating of the connectors 20, 40.

Once the coupling nut 70 has been assembled to the first and second bodies 80, 84 the exposed outer insulator 58 is electrically coupled to the rear portion of the first body 80, typically by soldering. The heat shrinkable tube 42 is moved forward in mating direction D and advanced over the rear portion of the first body 80 and heated to shrink the tubing over the electrical connection of the outer insulator 58 to the first body 80 to further insulate the connection area.

Figure 6:
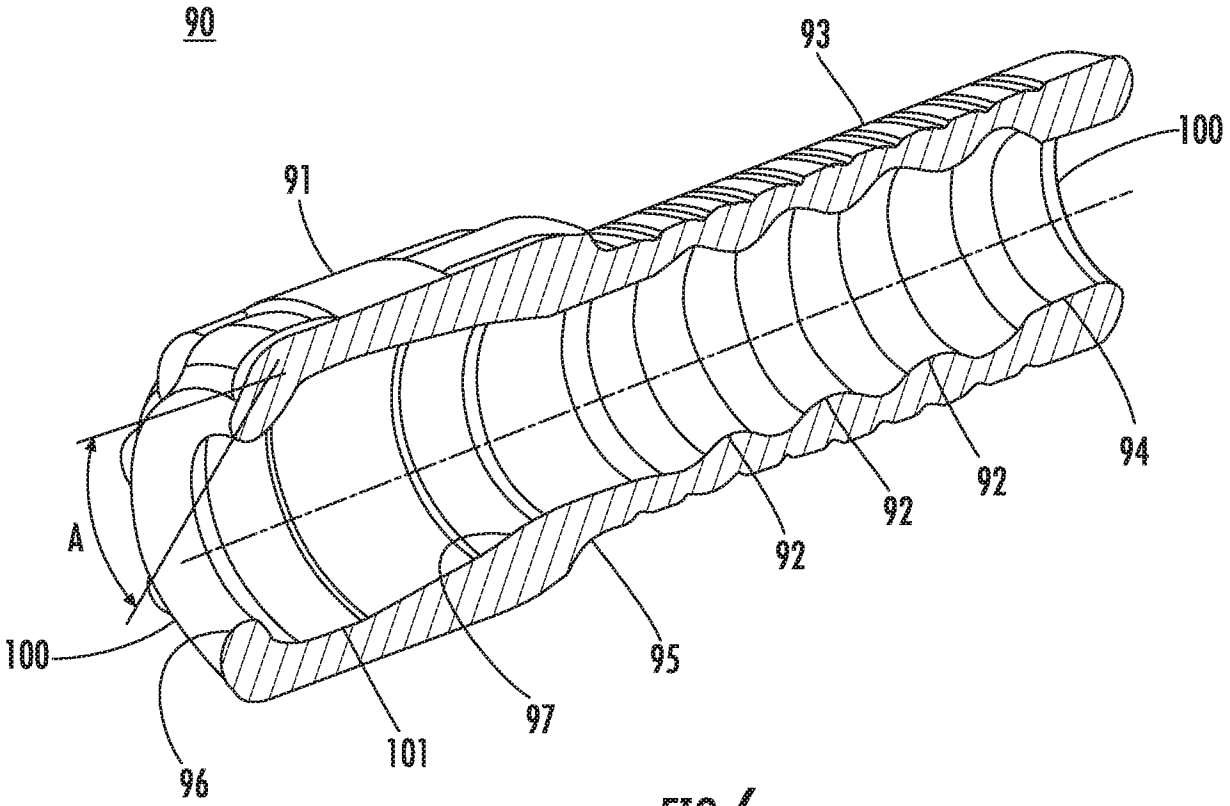
FIG. 6 is a section view of the boot of the plug connector of FIG. 3.

As best shown in FIGS. 5 and 6, in this embodiment the boot 90 is formed from an elastomeric material such as silicone but other materials that have similar properties can be appreciated. The boot 90 has an elongated cylindrical shape and is formed with a gripping end 93 and an enlarged end 91. An opening 100 extends through the boot 90 from the gripping end 93 to the enlarged end 91 defining a wall 95. Recesses are formed on the exterior of the wall 95 providing a grip area to aid in the actuation of the boot 90 by the user. The use of recesses provides a textured area for the use to grip and does not require any projections that would unnecessarily increase the overall diameter of the boot 90 and connector assembly 10. On the internal side of the wall 95 a plurality of projections 92, 94 is formed extending radially and elastically engage the exterior surface of the heat shrinkable tube 42 and the exterior jacket 56 of the cable 50. The projections provide a water and debris barrier between the boot 90 and the cable 50 minimizing moisture and debris from entering the connector system 10.

As further illustrated in FIG. 6 the enlarged end 91 of the boot 90 includes an internal space 101 that is configured to enclose the coupling nut 70. The internal space 101 is formed to closely resemble the exterior profile of the coupling nut 70. The edge of the opening 100 at the enlarged end 91 of the boot 90 has a circular cross section encircling the periphery of the opening 100 that forms a sealing lip 96. The lip 96 extends either forward or rearward form the opening 100 and is formed from the wall 95 at an acute angle A from the horizontal. In the embodiment shown, the lip 96 has a circular cross-section but other geometries can be appreciated. Additionally, the relationship between the internal space 101 and the exterior of the enlarged end 91 of the boot 90 defines the pliancy of the enlarged end 91. By altering these geometries, the wall 95 can be varied to control the ability of the boot 90 to be stretched and elastically restored thereby allowing a degree of adjustability for the operational characteristics of the boot 91. Therefore the installation force of the boot 91 and compression of the sealing lip 96 can be adjusted. Similarly, the gripping end 93 of the boot 91 can be adjusted as well.

In operation, the plug connector 40 is mated to the receptacle connector 20 by first aligning the opening 76 in the coupling nut 70 to the mating end 34 of the receptacle 20 as depicted in FIG. 7. FIGS. 7-10 depict the sequence of mating and installation of the sealing boot 90. Once aligned, the mating end 34 the cable assembly 40 is brought into contact with the receptacle connector 20 by inserting the center contact 86 into the mating end 23 of the center conductor 22 of the receptacle connector 20. The coupling nut 70 has internal threads 77 formed in the opening 76 that engage the external threads on the receptacle connector 60. The coupling nut 70 is turned to tighten and draw the connectors 20, 40 together to a completely mated position. At this time, both the center conductor 22 and center contact 86 are mated together complete the electrical connection for the signal portion of the connector assembly 10. Simultaneously, the inner mating cylindrical portion 83 engages the cylindrical stepped portion 33 completing the electrical ground circuit. Additionally, the connection between the threads 35 of the mating end 34 of the receptacle connector 20 also creates an electrical connection with the threaded portion 77 of the coupling nut 70 providing an additional ground connection.

The front face of the receptacle connector abuts the elastomeric gasket 74 in the opening 76 of the coupling nut 70 and upon tightening of the coupling nut 70, compresses the elastomeric gasket 74 providing a moisture resistant connection between the receptacle connector 20 and the plug connector 60. The elastomeric gasket 74 is formed from silicone but other compressible materials can be appreciated.

Figure 11:
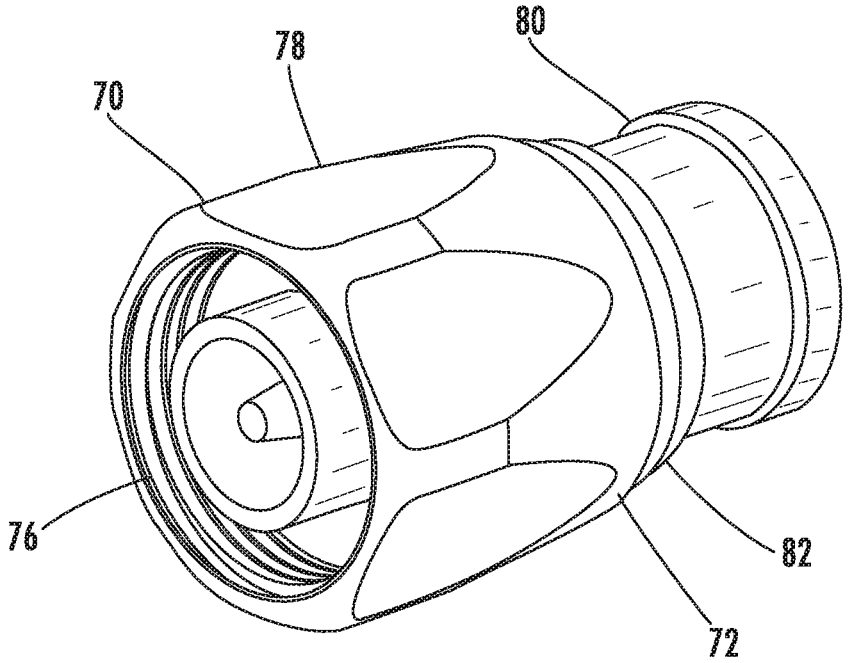
FIG. 11 is a perspective view of the locking nut of the plug connector.
Figure 12:
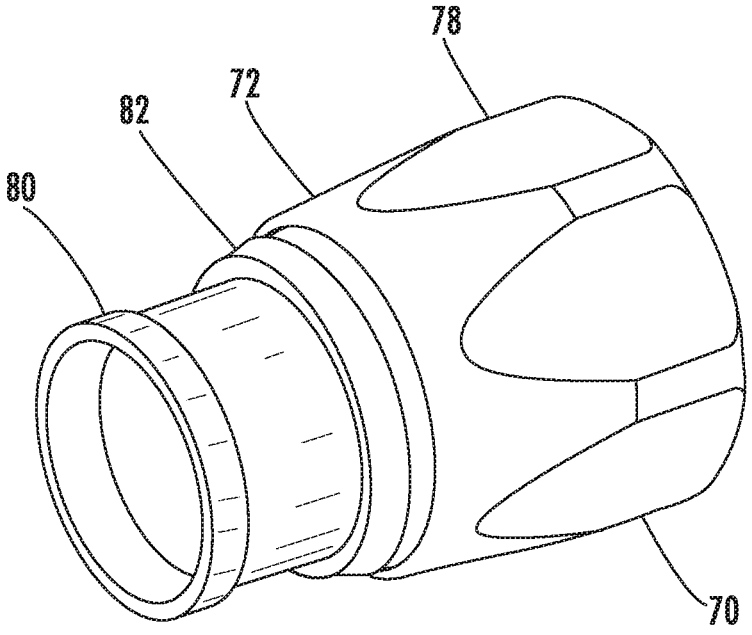
FIG. 12 is a reverse perspective view of the locking nut of FIG. 10.

After completely tightening the locking nut 70, the boot 90 is moved forward over the plug connector 60 with the front portion or sealing lip 96 engaging the rear portion of the coupling nut 70 and first body 80. As can be appreciated, the coupling nut 70 and first body 82 are formed with a tapered surface 72, 82 that is configured to allow a boot to translate smoothly over them as best shown in FIGS. 11 and 12. In the embodiment show, the tapered surfaces 72, 82 are shown as being flat but other surface configurations can be appreciated such as circular or curved.

Upon further advancement of the boot 90 the leading edge of the sealing lip 96 abuts the tapered surfaces of the first body 80 and the coupling nut 70 and the circular section of the sealing lip 96 rides on the tapered surfaces and is stretched over the exterior of the coupling nut 70 without folding or rolling over. The boot 90 is moved to an installed position wherein the sealing lip 96 is advance over the coupling nut 70 wherein the enlarged end 91 elastically recovers snapping back to its un-stretched state with a tactile pop. The sealing lip 96 compresses on the body 32 of the housing 30 receptacle connector 20 and being fitted over the mating end 34 of the receptacle connector 20, so as to completely encapsulate the connection between the plug and receptacles connectors providing a water resistant covering. As described above, the internal space 101 conforms to the exterior shape of the coupling nut 70, in particular the tapered surface 72 of the coupling nut 70 engages a confronting tapered surface 97 formed in the opening 100 on the interior of the boot 90 preventing the boot 90 from being moved beyond the installed position.

Unlike existing designs that typically include a molded projection or tab for grasping to manually stretch the boot during installation requiring two hands to operate, however, the boot and coupling nut are configured so that the boot can be translated into an installed sealed position with one hand operation. The boot 90 of the current embodiment includes recesses formed in the gripping end 93 of the boot. In applications where several cable connector assemblies are used, maintaining a minimal profile is required, so boots formed with large tabs or ears, or boots that require two handed installation cannot be used.

It will be understood that there are numerous modifications of the illustrated embodiments described above which will be readily apparent to one skilled in the art, such as many variations and modifications of the compression connector assembly and/or its components including combinations of features disclosed herein that are individually disclosed or claimed herein, explicitly including additional combinations of such features, or alternatively other types of contact array connectors. Also, there are many possible variations in the materials and configurations.

What is claimed:

1. A cable assembly, comprising:

a connector having a first body and a second body, the second body portion retained in the first body;

a coaxial cable secured to the connector, the coaxial cable having a center conductor and an outer conductor;

a coupling nut rotationally captivated between the first body and the second body, the coupling nut having a rear portion opposite a mating end, the coupling nut rear portion having a tapered surface;

a boot having an opening and disposed on the cable having an enlarged end and movable between an initial position and an installed position along a mating direction; and wherein the boot has a sealing lip formed on the enlarged end of the boot that is configured to slide over the tapered surface of the coupling nut upon movement from the initial position to the installed position, and wherein a tapered surface is formed in the opening of the boot and configured to engage the tapered surface of the coupling nut.

2. The cable assembly of claim 1, wherein the sealing lip has a circular cross-section.

3. The cable assembly of claim 1, wherein the boot is formed from an elastomeric material.

4. The cable assembly of claim 3, wherein the elastomeric material is silicone.

5. The cable assembly of claim 1, wherein the sealing lip is formed at an angle.

6. The cable assembly of claim 5, wherein the angle is acute to the mating direction.

7. The cable assembly of claim 1, wherein a projection is formed in the opening of the boot that engages the coaxial cable.

8. A method for producing a connector assembly comprising:

providing a receptacle connector having a housing, the housing including a mating end;

providing a cable;

placing a boot on the cable, the boot including an opening and an enlarged end, the enlarged end having a sealing lip with a tapered surface;

securing a plug connector to the cable, the plug connector including a coupling nut rotationally captivated between a first body and a second body, the coupling nut having a rear portion opposite a mating end, the coupling nut rear portion including a tapered surface, the plug connector adapted to engage the mating end of the receptacle connector;

connecting the plug connector to the receptacle connector; and installing the boot over the plug connector and the receptacle connector wherein the tapered surface of the sealing lip rides over the tapered surface of the coupling nut and engages the housing of the receptacle connector.

9. A connector assembly comprising:

a receptacle having a housing, the housing including an insulator disposed in the housing, a center contact secured in the insulator;

a cable assembly including a plug connector connected to a cable, the plug connector having a coupling nut rotationally secured between a first body and a second body, the coupling nut having a rear portion opposite a mating end, the coupling nut rear portion including a tapered surface, and a boot including an opening, the boot being slidably disposed on the cable in an initial position and movable to an installed position; and wherein the boot has a sealing lip that is configured to slide over the tapered surface of the coupling nut and engage the housing upon movement of the boot to the installed position along a mating direction, and wherein a tapered surface is formed in the opening of the boot and configured to engage the tapered surface of the coupling nut.

10. The connector assembly of claim 9, wherein the coupling nut includes a threaded portion.

11. The connector assembly of claim 10, wherein the threaded portion of the coupling nut engages a threaded portion formed on the housing.

12. The connector assembly of claim 9, wherein the sealing lip has a circular cross section.

13. The cable assembly of claim 9, wherein the sealing lip is formed at an angle.

14. The cable assembly of claim 13, wherein the angle is acute to the mating direction.

15. The method for producing a connector assembly of claim 8, wherein installing the boot is performed with one hand.

16. The cable assembly of claim 9, wherein a projection is formed in the opening of the boot that engages the cable.

17. The cable assembly of claim 9, wherein the boot includes a grip area.

18. The cable assembly of claim 17, wherein recesses are formed on the grip area.

* * * * *